US007782187B2

(12) United States Patent
Kondo et al.

(10) Patent No.: US 7,782,187 B2
(45) Date of Patent: Aug. 24, 2010

(54) MONITORING APPARATUS

(75) Inventors: Junji Kondo, Tokyo (JP); Kenji Inomata, Tokyo (JP); Takahide Hirai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 286 days.

(21) Appl. No.: 11/859,159

(22) Filed: Sep. 21, 2007

(65) Prior Publication Data

US 2008/0258914 A1 Oct. 23, 2008

(30) Foreign Application Priority Data

Apr. 18, 2007 (JP) ..... 2007-109625

(51) Int. Cl.
*G08B 19/00* (2006.01)

(52) U.S. Cl. ..... 340/522; 340/523; 340/517

(58) Field of Classification Search ..... 340/505, 340/506, 509, 517, 518, 522, 523, 528, 545.3, 340/572.1; 700/245; 356/4.01, 5.01; 342/70
See application file for complete search history.

(56) References Cited

U.S. PATENT DOCUMENTS 6,727,844 B1 * 4/2004 Zimmermann et al. ..... 342/70
7,106,421 B2 * 9/2006 Matsuura et al. ..... 356/4.01
7,123,126 B2 * 10/2006 Tanaka et al. ..... 340/5.2
7,289,881 B2 * 10/2007 Ota et al. ..... 700/245
7,456,739 B2 * 11/2008 Inomata et al. ..... 340/552
2007/0210911 A1 * 9/2007 McCulloch et al. ..... 340/507

FOREIGN PATENT DOCUMENTS

JP 7-116981 5/1995
JP 2000-69459 3/2000
JP 2004-138402 5/2004

* cited by examiner

*Primary Examiner*—Van T. Trieu
(74) *Attorney, Agent, or Firm*—Oblon, Spivak, McClelland, Maier & Neustadt, L.L.P.

(57) ABSTRACT

A position detection sensor using electromagnetic wave (1) estimates the position of a monitor object (100) in a first detection region (101), and outputs it as a first possibility distribution. A second sensor (4) estimates the position of the monitor object (100) in a second detection region (102), and outputs it as a second possibility distribution. A distribution computing means (5) outputs an integrated possibility distribution which it obtains by integrating the possibility distributions of the position of the monitor object 100 which are acquired by these sensors. An information presenting means (6) outputs the integrated possibility distribution as information about the most possible position of the monitor object (100).

12 Claims, 5 Drawing Sheets

MONITORING APPARATUS

BACKGROUND OF THE INVENTION

1. Field of the Invention

The present invention relates to a monitoring apparatus of computing a new output from outputs of two sensors so as to, for example, detect a person who is staying in a monitored area.

2. Description of Related Art

Prior art monitoring apparatus use a plurality of different sensors for the main purpose of complementing monitor region, space, and target which cannot be covered by each of the plurality of different sensors (for example, refer to patent reference 1).

[Patent reference 1] JP,2000-69459,A

In a prior art monitoring apparatus using a combination of a plurality of types of sensors, the functions of one of them which cannot be covered through the use of only a single sensor of another type can be complemented by combining outputs of the plurality of types of sensors. For example, although the use of a single monitoring camera cannot implement a function of appropriately restricting the time zone during which the monitored image is to be recorded, this function can be complemented by using an infrared sensor and then starting recording of the image of the monitoring camera in response to an alarm from the infrared sensor. For this reason, the sensing functions of a prior art monitoring apparatus depend upon each of a plurality of sensors disposed therein, and the sensing functions do not have a total sensing capability which exceeds the capability of each of the plurality of sensors. Therefore, in order to improve the accuracy of monitoring of a prior art monitoring apparatus, the capability of each of a plurality of sensors included has to be improved.

SUMMARY OF THE INVENTION

The present invention is made in order to solve the above-mentioned problem, and it is therefore an object of the present invention to provide a monitoring apparatus which can improve the detection accuracy of the whole monitoring apparatus.

In accordance with the present invention, there is provided a monitoring apparatus including: a first sensor for outputting a first possibility distribution of occurrence of an event in a first monitor area; a second sensor for outputting a second possibility distribution of occurrence of the event in a second monitor area which overlaps the first monitor area; a distribution computing means for computing an integrated possibility distribution of occurrence of the event in a common portion where the first monitor area and the second monitor area overlap each other on the basis of the first possibility distribution and the second possibility distribution; and an information presenting means for outputting the integrated possibility distribution acquired by the distribution computing means.

The monitoring apparatus of the present invention thus computes the integrated possibility distribution of the occurrence of the event on the basis of the first possibility distribution obtained by the first sensor and the second possibility distribution obtained by the second sensor. Therefore, the present invention can improve the detection accuracy of the whole monitoring apparatus.

Further objects and advantages of the present invention will be apparent from the following description of the preferred embodiments of the invention as illustrated in the accompanying drawings.

DETAILED DESCRIPTION OF THE PREFERRED EMBODIMENTS

Embodiment 1

Figure 1:
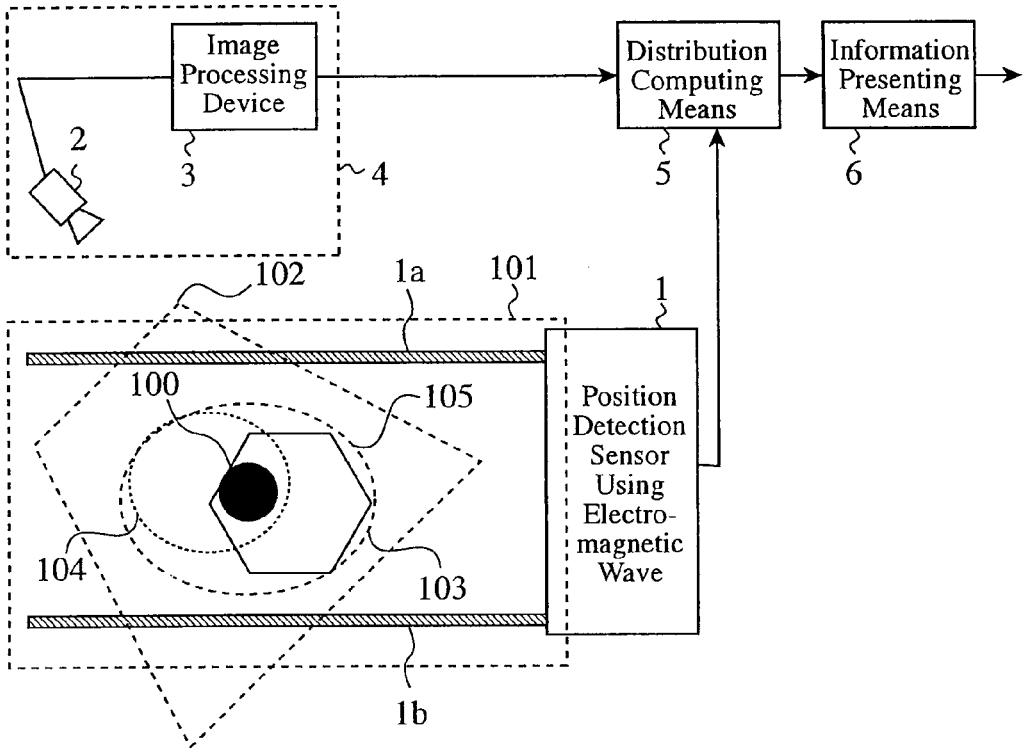
FIG. 1 is a block diagram showing a monitoring apparatus in accordance with embodiment 1 of the present invention.

FIG. 1 is a block diagram showing a monitoring apparatus in accordance with embodiment 1 of the present invention. In the figure, the monitoring apparatus is provided with a position detection sensor using electromagnetic wave (i.e., a first sensor) 1, a second sensor 4 which consists of an image pickup device 2 and an image processing device 3, a distribution computing means 5, and an information presenting means 6.

The position detection sensor using electromagnetic wave 1 has two leaky coaxial cables (LCX) 1*a* and 1*b* so as to detect the position of a monitor object 100 which exists between the LCX 1*a* and 1*b*. This position detection sensor using electromagnetic wave 1 is, for example, a sensor disclosed by, for example, JP,2004-138402,A, and the detailed explanation of the position detection sensor will be omitted hereafter because the sensor is well known. The image pickup device 2 is a camera for acquiring an image of a specific area, and the image processing device 3 is a unit which detects the position of the monitor object 100 from the image acquired by the image pickup device 2 by performing image processing on the image. Because a process of detecting the monitor object 100 of the image processing device 3 is well known, the explanation of the detecting process will be omitted hereafter. The position detection sensor using electromagnetic wave 1 and the second sensor 4 are arranged so that a first detection region (i.e., a first monitor area) 101 which is monitored by the position detection sensor using electromagnetic wave 1 overlaps a second detection region (i.e., a second monitor area) 102 which is monitored by the second sensor 4. The distribution computing means 5 is a unit for computing a distribution of the detected position on the basis of both the output of the position detection sensor using electromagnetic wave 1, and the output of the image processing device 3. The information presenting means 6 is a unit for outputting information, for example, for displaying the distribution computed by the distribution computing means 5 on a display not shown in the figure.

Next, the operation of the monitoring apparatus according to embodiment 1 will be explained. In accordance with this embodiment, in order to detect and monitor the position of the monitor object 100, the two types of sensors, i.e., the position detection sensor using electromagnetic wave 1 and the second sensor 4 which consists of the image pickup device 2 and the image processing device 3 are provided, and the position of the monitor object 100 continues to be monitored. Conventionally, even though a prior art monitoring apparatus has such a structure, in most cases, detection of a region which cannot be monitored by either the position detection sensor using electromagnetic wave 1 or the second sensor 4 is complemented by detection of another region which can be monitored by the other sensor. For example, when the monitor region of the second sensor 4 is narrow, the prior art monitoring apparatus monitors a larger region by using the position detection sensor using electromagnetic wave 1 while it controls the second sensor 4 if needed so as to capture an image of a monitor object to be monitored and monitor the position of the monitor object using the second sensor 4. In most cases, because the prior art monitoring apparatus determines the position of the monitor object on the basis of sensing information about the sensing obtained by either the position detection sensor using electromagnetic wave 1 or the second sensor 4, the prior art monitoring apparatus cannot acquire information having a degree of accuracy exceeding the position detection accuracy of either the position detection sensor using electromagnetic wave 1 or the second sensor 4. Furthermore, because position detection signals outputted from these sensors are acquired by the sensors of different-types, there is no correlation between them and they are independent of each other. Generally, whether to select, as correct information, either of the position detection signals outputted from the position detection sensor using electromagnetic wave 1 and the second sensor 4 for a region in which the position of the monitor object can be detected by both the position detection sensor using electromagnetic wave 1 and the second sensor 4 is left to the discretion of how to use the monitoring apparatus. Therefore, even if the plurality of position detection signals can be acquired, the prior art monitoring apparatus simply selects either one of them, and therefore the accuracy of detecting the position of the monitor object depends on the detection accuracy of each of the sensors and therefore cannot exceed this accuracy. Furthermore, it is difficult to use the plurality of different sensor output signals by simply combining them because there is no correlation among them.

Therefore, the monitoring apparatus in accordance with this embodiment is so constructed as to operate more efficiently by integrating the outputs of the plurality of types of sensors for which such a correlation cannot be easily defined. Hereafter, the concrete operation of the monitoring apparatus of this embodiment will be explained.

First, when the monitor object 100 exists in only either one of the first detection region 101 which is monitored by the position detection sensor using electromagnetic wave 1 and the second detection region 102 which is monitored by the second sensor 4 (i.e., when the detection signal is acquired from only one of the sensors), the distribution computing means 5 and the information presenting means 6 operate on the basis of the output of the sensor from which the detection signal is acquired. In other words, in this case, the output of the sensor from which the detection signal is acquired becomes the output of the information presenting means 6, just as it is. In this embodiment, assume, as monitoring of occurrence of an event different from normal events, detection of an invader to a monitor area or detection of the position of a monitor object which exists in a monitor area.

Next, when the monitor object 100 exists in a region portion in which the first detection region 101 and the second detection region 102 overlap each other, the distribution computing means 5 computes a possibility distribution of the position of the monitor object 100 on the basis of the output of the position detection sensor using electromagnetic wave 1 and the output of the image processing device 3. Because the position detection sensor using electromagnetic wave 1 and the second sensor 4 are position detecting sensors, each of their position detection output signals is generally outputted as information about a point. In an internal process, information about a point with the highest degree of reliability or probability among a plurality of detected candidates for the position where the monitor object 100 can be assumed to exist is outputted as a detected result.

Figure 2:
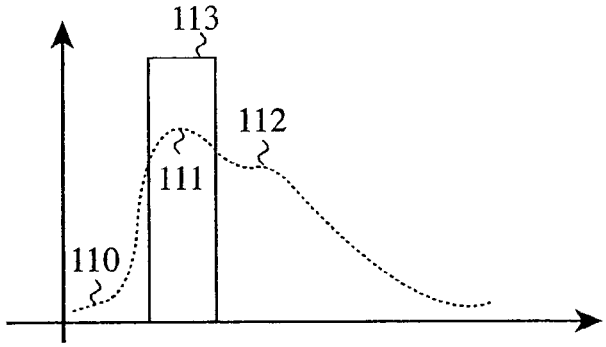
FIG. 2 is an explanatory diagram showing the operation of a position detection sensor using electromagnetic wave of the monitoring apparatus in accordance with embodiment 1 of the present invention.

FIG. 2 is an explanatory diagram showing a possibility distribution of the position of the monitor object 100 which is detected by the position detection sensor using electromagnetic wave 1. In the figure, the horizontal axis shows positions, the vertical axis shows the possibility of each position, and the curve of a first possibility distribution 110 shows the possibility distribution of the position of the monitor object which is detected by the position detection sensor using electromagnetic wave 1. In the shown detected result, because the possibility distribution has two peaks (peaks 111 and 112) and the peak 111 has a higher possibility, positions in the vicinity of this peak 111 are outputted as assumed positions 113 of the monitor object 100. In FIG. 1, 103 denotes a range of the assumed positions of the monitor object 100 which are determined by the position detection sensor using electromagnetic wave 1.

Figure 3:
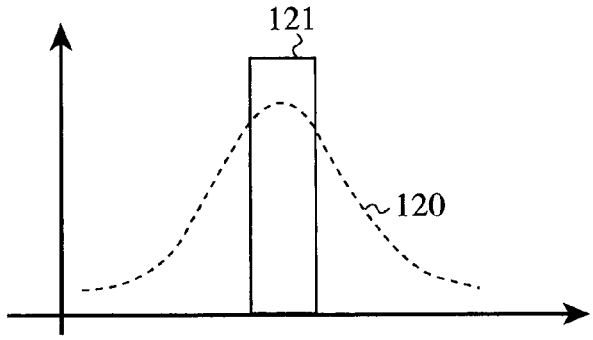
FIG. 3 is an explanatory diagram showing the operation of a second sensor of the monitoring apparatus in accordance with embodiment 1 of the present invention.

The second sensor 4 carries out an operation of detecting the position of the monitor object 100 as follows. FIG. 3 is an explanatory diagram showing a possibility distribution of the position of the monitor object 100 which is detected by the second sensor 4. In the figure, the horizontal axis and the vertical axis show positions and their possibilities, respectively, like those of FIG. 2, and the curve of a second possibility distribution 120 shows the possibility distribution of the position of the monitor object which is detected by the second sensor 4. Reference numeral 121 denotes assumed positions of the monitor object 100 which is determined by the second sensor 4, and, in FIG. 1, 104 denotes a range of the assumed positions of the monitor object 100 which is determined by the second sensor 4.

Figure 4:
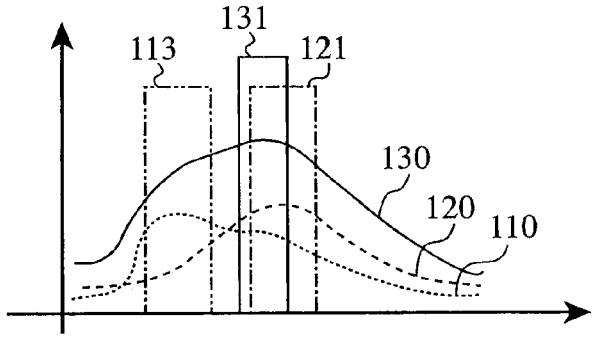
FIG. 4 is an explanatory diagram showing a relation among possibility distributions of the monitoring apparatus in accordance with embodiment 1 of the present invention.

The distribution computing means 5 computes a position range of the monitor object 100 on the basis of such the outputs of the position detection sensor using electromagnetic wave 1 and the second sensor 4. FIG. 4 is an explanatory diagram showing the computation of such a position range. For example, when the monitor area is in a weather state, such as a rainy weather state, there occur heavy noises being accumulated in the image acquired by the image pickup device 2 during the image processing carried out by the image processing device 3, and therefore many high frequency components exist in the second possibility distribution 120 as a result, the distribution computing means 5 smooths the output signal of the image pickup device or smooths the noises using a low pass filter. On the other hand, when the output (the first possibility distribution 110) of the position detection sensor using electromagnetic wave 1 is flat under the influence of a wind or the like, the distribution computing means 5 carries out a process of emphasizing changes in the sensor output. Or when an abnormality resulting from a failure or the like of the position detection sensor using electromagnetic wave 1 appears in the output at a unique point of the position detection sensor using electromagnetic wave 1, the distribution computing means 5 sets a distribution value at this unique point of the first possibility distribution 110 to 0, and emphasizes the second possibility distribution 120. Next, after performing proper weighting (a multiplication by a certain numeric value) on the first possibility distribution 110 and the second possibility distribution 120, the distribution computing means 5 performs an addition of the first possibility distribution 110 and the second possibility distribution 120 to form an integrated possibility distribution 130 which is an integrated distribution curve.

When performing the weighting, if judging that, for example, a failure, an abnormality, or a malfunction has occurred in one of the sensors, the distribution computing means 5 decreases the weight assigned to the sensor. Furthermore, according to the characteristics of each of the sensors, the distribution computing means can change the weight assigned to each sensor. For example, in consideration of the influence of increase in noises in the image from the image pickup device 2 due to shaking of the image pickup device 2 at a time when a strong wind is blowing, the distribution computing means can reduce the weight by which the second possibility distribution 120 of the second sensor 4 is multiplied. Furthermore, in consideration of the influence of reflection of electromagnetic waves by moisture at a time of rainy weather, the distribution computing means can reduce the weight by which the first possibility distribution 110 of the position detection sensor using electromagnetic wave 1 is multiplied. In addition, because the reliability of the second sensor 4 is improved when monitoring of a point in the vicinity of the image pickup device 2, the distribution computing means can increase the weight by which the second possibility distribution 120 is multiplied. When computing the integrated possibility distribution 130, the distribution computing means can further improve the reliability of the computation by, for example, adding the first possibility distribution 110 and the second possibility distribution 120 only at positions at each of which they have values other than zero (i.e., by performing an addition of the first possibility distribution 110 and the second possibility distribution 120 after implementing an AND logical operation on them). As shown in FIG. 4, the distribution computing means then defines positions with a higher possibility in the integrated possibility distribution 130 which are acquired in this way as new assumed positions 131. In FIG. 1, 105 denotes a range of the new assumed positions of the monitor object 100 which are thus determined.

Figure 5:
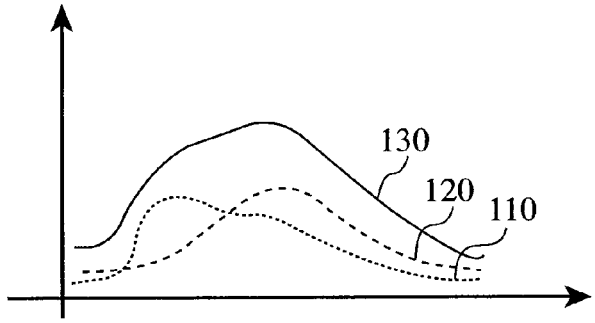
FIG. 5 is an explanatory diagram of information which is displayed by the monitoring apparatus in accordance with embodiment 1 of the present invention.

Next, the information presenting means 6 displays the possibility distribution which is computed by the distribution computing means 5 on a display or the like which is not shown in FIG. 1. FIG. 5 is an explanatory diagram showing information displayed. As shown in the figure, the first possibility distribution 110 obtained by the position detection sensor using electromagnetic wave 1, the second possibility distribution 120 obtained by the second sensor 4, and the integrated possibility distribution 130 are superimposed on one another.

Figure 6:
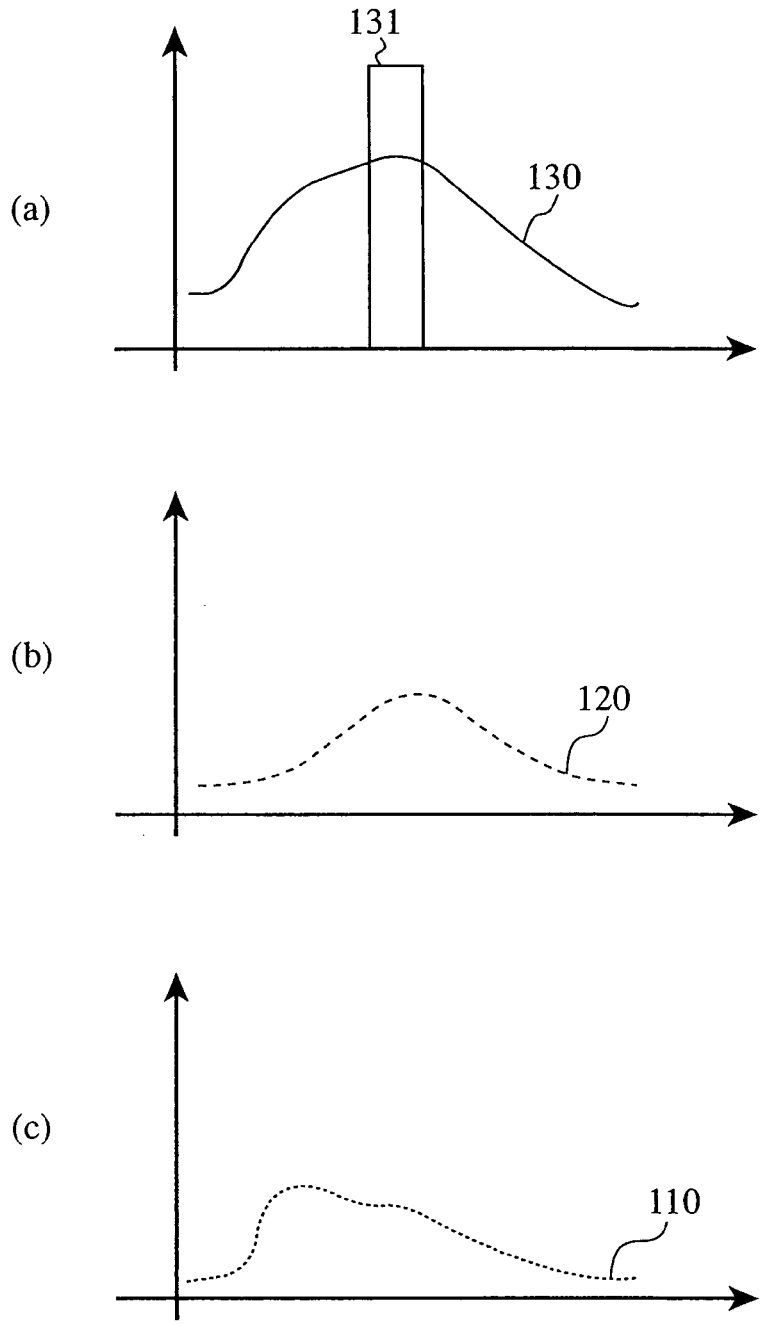
FIGS. 6(*a*) to 6(*c*) are explanatory diagrams showing another example of display of information by the monitoring apparatus in accordance with embodiment 1 of the present invention.

As an alternative, the possibility distributions 110, 120, and 130 can be displayed separately. FIG. 6 is an explanatory diagram showing another example of display of the information. For example, as shown in FIG. 6(*a*), only the integrated possibility distribution 130 and the assumed positions 131 are displayed. Furthermore, display switching can be carried out so that only the second the possibility distribution 120 is displayed, as shown in FIG. 6(*b*), or only the first possibility distribution 110 is displayed, as shown in FIG. 6(*c*). In either case, the assumed positions 113 or 121 as shown in FIG. 2 or 3 can be further displayed simultaneously on the screen. By thus displaying the first possibility distribution 110, the second possibility distribution 120, and the integrated possibility distribution 130 separately, even when, for example, the display for display of the information has a small size, the monitoring apparatus can improve the viewability of the display for guards or watchmen by displaying only needed information on the display.

Figure 7:
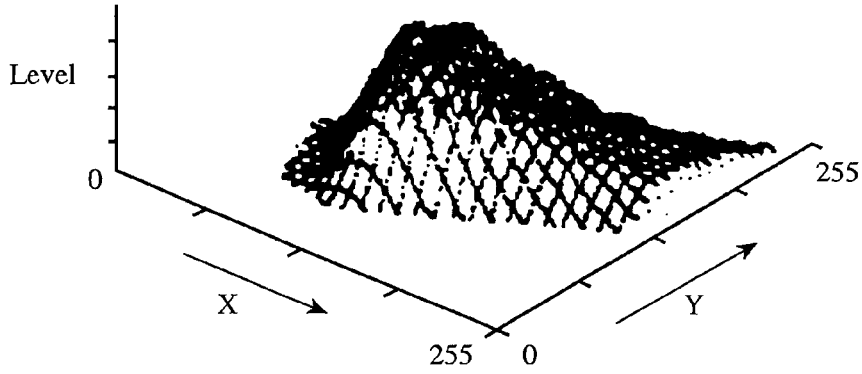
FIG. 7 is an explanatory diagram showing an example of display of information in three dimensions by the monitoring apparatus in accordance with embodiment 1 of the present invention.

In addition, as the method of displaying such a possibility distribution, an information presenting method of not only displaying a possibility distribution in the form of a graph, but superimposing it on a map in three dimensions can be used. FIG. 7 is an explanatory diagram showing an example of displaying a possibility distribution in three dimensions. When superimposing a possibility distribution on an on-screen map, the information presenting means 6 carries out a three-dimensional display as shown in FIG. 7 in order to visualize the possibility distribution, though the possibility distribution is originally expressed in a two-dimensional plane. A range in the vicinity of a peak in such a three-dimensional display corresponds to a region with the highest possibility where the monitor object 100 exists.

By carrying out such a display, the information presenting means can make the display be further intuitive and can improve the visibility of the display for guards or watchmen.

Figure 8:
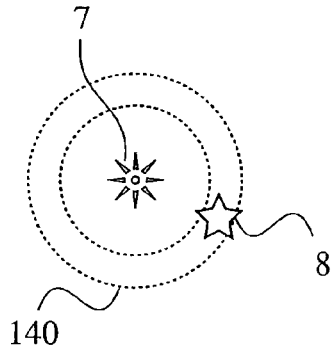
FIG. 8 is an explanatory diagram of a possibility distribution obtained by an RFID in another example of the monitoring apparatus according to embodiment 1 of the present invention.

In above-mentioned embodiment 1, an RFID (Radio Frequency Identification) can be used as the second sensor, instead of the combination of the image pickup device 2 and the image processing device 3. FIG. 8 is an explanatory diagram showing a possibility distribution which is obtained by the RFID. An active RFID can be used as the RFID. In the active RFID, a tag itself produces an electromagnetic wave with a power supply which the tag has. Therefore, the electromagnetic wave can be detected even if the distance between the RFID tag and a tag sensor of the RFID is of the order of several meters. As shown in FIG. 8, when the number of tag sensors 7 of the RFID is one, in detection of the RFID tag 8, the direction of the tag cannot be detected, but only the strength of the electromagnetic wave emitted out of the RFID tag 8 can be detected. As a result, the distance between the tag sensor 7 and the RFID tag 8 can be acquired with a certain degree of accuracy from the strength of the electromagnetic wave. Therefore, when the electromagnetic wave emitted out of the RFID tag 8 is received by the tag sensor 7, it can be assumed that the RFID tag 8 exists in somewhere at some fixed distance from the tag sensor, i.e., somewhere in a doughnut-shaped range 140 shown in the figure. This range 140 is a possibility distribution of the existence of the RFID tag 8, and corresponds to each of the first above-mentioned possibility distribution 110 and the above-mentioned second possibility distribution 120. Even in such a case, by using the position detected result of the position detection sensor using electromagnetic wave 1, the detection of the position of the tag can be carried out surely from integration of two or more detected position ranges.

Furthermore, because many ranges 140 can be acquired in a case in which may tag sensors 7 are arranged, a region where these ranges overlap can be detected as a region with the highest probability of the existence of the tag, and therefore the detection accuracy can be further improved.

As mentioned above, the monitoring apparatus according to embodiment 1 for monitoring occurrence of an event different from normal events includes: the first sensor for outputting a first possibility distribution of occurrence of the event in a first monitor area; a second sensor for outputting a second possibility distribution of occurrence of the event in a second monitor area which overlaps the first monitor area; the distribution computing means for computing an integrated possibility distribution of occurrence of the event in a common portion where the first monitor area and the second monitor area overlap each other on the basis of the first possibility distribution and the second possibility distribution; and the information presenting means for outputting the integrated possibility distribution acquired by the distribution computing means. Therefore, the detection accuracy of the whole monitoring apparatus can be further improved as compared with the case where a plurality of sensors are simply used.

Furthermore, in the monitoring apparatus according to embodiment 1, the first and second sensors are of different types. Therefore, the monitoring apparatus can correct errors which are difficult to correct by using only one kind of sensor by using the combination of the first and second sensors, and can carry out highly accurate detection of the position of the monitor object.

In addition, in the monitoring apparatus according to embodiment 1, the event different from normal events is a person's intrusion into a monitor area. Therefore, the monitoring apparatus can detect any invader into the monitored area with high accuracy.

Furthermore, in the monitoring apparatus according to embodiment 1, the monitoring of the occurrence of the event different from normal events is detection of a position of an object which exists in a monitor area. Therefore, the monitoring apparatus can carry out detection of the position of an object which exists in the monitored area with high accuracy.

In addition, in the monitoring apparatus according to embodiment 1, the first sensor is a position detection sensor using electromagnetic wave, and the second sensor includes an image pickup device for acquiring an image of the second monitor area and an image processing device for detecting occurrence of the event different from normal events from the image acquired by the image pickup device. Therefore, the monitoring apparatus can detect occurrence of an event different normal events with high accuracy.

Furthermore, in the monitoring apparatus according to embodiment 1, the first sensor is a position detection sensor using electromagnetic wave, and the second sensor is a tag sensor for detecting the position of an RFID tag. Therefore, the monitoring apparatus can detect occurrence of an event different normal events with high accuracy.

In addition, in the monitoring apparatus according to embodiment 1, the information presenting means outputs the first possibility distribution of the first sensor and the second possibility distribution of the second sensor separately. Therefore, the monitoring apparatus can improve the viewability of the display for guards or watchmen by displaying only needed information.

Embodiment 2

In above-mentioned embodiment 1, the combination of the image pickup device and the position detection sensor using electromagnetic wave is shown as an example. Instead of this combination, sensors each including a processing unit having a probability distribution of the existence of a monitor object can be used. More specifically, sensors each for detecting passage of a monitor object, such as an infrared sensor or a photoelectric sensor, except for sensors without any possibility distribution of the existence of a monitor object in performing internal processing in order to detect the position of the monitor object, but having characteristics close to digital outputs, can be similarly used. In this embodiment 2, such an example of use of sensors each for detecting passage of a monitor object, such as an infrared sensor or a photoelectric sensor, will be explained.

Figure 9:
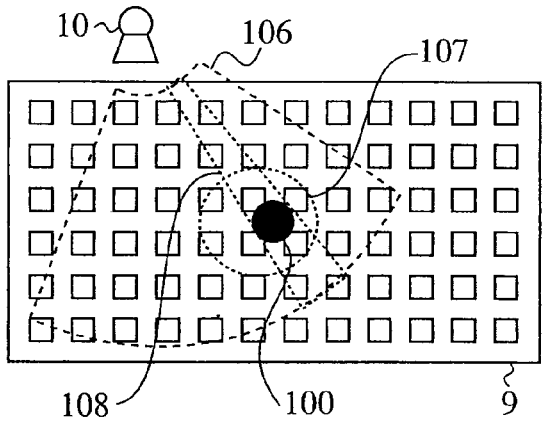
FIG. 9 is an explanatory diagram showing a plurality of sensors of a monitoring apparatus in accordance with embodiment 2 of the present invention.

FIG. 9 is an explanatory diagram showing sensors of a monitoring apparatus in accordance with embodiment 2. In this embodiment 2, a pressure-sensitive position detecting sensor 9 is used as the first sensor, and a laser radar 10 is used as the second sensor. The pressure-sensitive position detecting sensor 9 detects the position of a monitor object 100 existing in a region (i.e., a rectangular region in the figure) which is a first monitor area by using a plurality of pressure-sensitive sensors. The laser radar 10 two-dimensionally scans laser light so as to detect the position of the monitor object 100. In the figure, 106 denotes a second detection region (i.e., a second monitor area). Probability distributions of the position where the monitor object 100 can be assumed to exist by the monitoring apparatus by using the pressure-sensitive position detecting sensor 9 and the laser radar 10 correspond to regions 107 and 108, respectively.

Because the structures and operations of the distribution computing means 5 and the information presenting means 6 in accordance with embodiment 2 are the same as those of embodiment 1, schematic representations and detailed explanations of them will be omitted hereafter. More specifically, the distribution computing means 5 computes an integrated possibility distribution on the basis of the possibility distributions which correspond to the region 107 in which the monitor object 100 can be assumed to exist on the basis of the detection results from the pressure-sensitive position detecting sensor 9, and the region 108 in which the monitor object 100 can be assumed to exist on the basis of the detection results from the laser radar 10, like that of embodiment 1, and the information presenting means 6 displays the integrated possibility distribution. The monitoring apparatus thus makes it possible to freely combine sensors each of which provides a possibility distribution in detection of a monitor object. In a case where a region which possibility distributions overlap exists, there is no restriction on the number of sensors combined.

As mentioned above, in the monitoring apparatus according to embodiment 2, the first sensor is a range sensor using laser scanner, and the second sensor is a pressure-sensitive position detecting sensor. Therefore, the monitoring apparatus can detect occurrence of an event different normal events with high accuracy.

Embodiment 3

In above-mentioned embodiments 1 and 2, an integrated possibility distribution is obtained on the basis of the outputs of the first and second sensors, as previously explained. In this embodiment 3, an example of performing a calibration on a sensor will be explained. More specifically, a sensor for detecting the position of a monitor object on the basis of a probability distribution, like the position detection sensor using electromagnetic wave 1 and the second sensor 4 which are explained in embodiment 1, needs an algorithm of determining the detected position of the monitor object from the probability distribution, a threshold process, adjustment of the sensitivity of the sensing function thereof, etc., and a balance among them determines most of the detection accuracy. Therefore, an operation of achieving a balance among them (a calibration operation) is generally needed. In performing a calibration operation, in order to improve the accuracy of a target sensor, another reference with high accuracy needs to be prepared and adjustment needs to be performed on the target sensor on the basis of this reference. Therefore, in a case in which a prior art calibration method is applied to the structure as shown in FIG. 1, it is necessary to arrange a sensor with higher accuracy temporarily, and carry out adjustment between this sensor and either the position detection sensor using electromagnetic wave 1 or the second sensor 4, or it is necessary to actually arrange a target for position detection and to perform a calibration by checking a signal outputted at a time of detecting the position of the target.

For this reason, the calibration is generally carried out only at a time when the monitoring apparatus is installed. A problem is therefore that it is difficult to adjust each of the sensors after each of the sensors is installed, and hence a sensor with higher accuracy or an installation operation with higher accuracy are needed and this results in increase in the cost of the monitoring apparatus. In contrast with this, in accordance with this embodiment 3, a calibration operation is performed by adjusting the possibility distributions 110 and 120 again on the basis of the integrated possibility distribution 130 in order to solve the problem. Hereafter, the calibration operation will be explained concretely.

Figure 10:
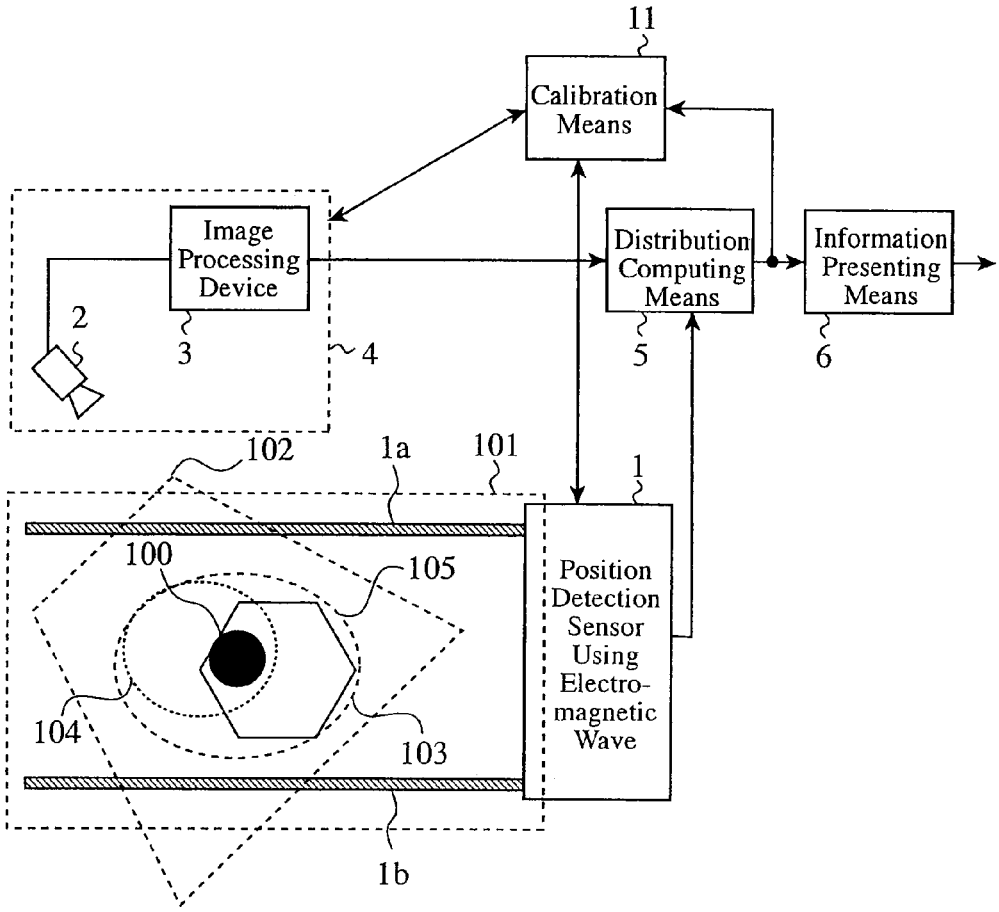
FIG. 10 is a block diagram of a monitoring apparatus in accordance with embodiment 3 of the present invention.

FIG. 10 is a block diagram of a monitoring apparatus according to embodiment 3. In the shown structure, a calibration method of this embodiment is applied to embodiment 1. A calibration means 11 calibrates the output of either the position detection sensor using electromagnetic wave 1 or the second sensor 4 on the basis of the output of the distribution computing means 5. Because structural components other than this component are the same as those of embodiment 1, corresponding components are designated by the same reference numerals, and the explanation of the components will be omitted hereafter.

Next, the calibration operation in accordance with embodiment 3 will be explained. In the calibration operation, the parameters of a sensor are adjusted by using a correct value as a teacher signal. Hereafter, the calibration operation will be explained by taking, as an example, the case shown in FIG. 4. First, assume that the output result of the position detection sensor using electromagnetic wave 1 is the assumed positions 113, and the output result of the second sensor 4 is the assumed positions 121. These values are the results of processing the possibility distributions 110 and 120 derived from the parameters which the position detection sensor using electromagnetic wave 1 and the second sensor 4 currently have. On the other hand, the output which is obtained by integrating the output results is the assumed positions 131. Because this output can be assumed to be a signal showing a correct detection result in this system, it can also be assumed to be correct for both the position detection sensor using electromagnetic wave 1 and the second sensor 4, and the assumed positions 113 and 121 can be assumed to have large errors. Therefore, the calibration means performs a calibration by adjusting the parameters which either the position detection sensor using electromagnetic wave 1 or the second sensor 4 has to change the output shape of the possibility distribution 110 or 120 so that the output shape gets closer to that of the integrated possibility distribution 130 as close as possible. More specifically, the calibration means 11 changes the parameters which either the position detection sensor using electromagnetic wave 1 or the second sensor 4 has on the basis of the integrated possibility distribution 130 outputted from the distribution computing means 5 so that the output acquired from either the position detection sensor using electromagnetic wave 1 or the second sensor 4 gets closer to the assumed positions 131.

It should be noted that at the time of performing a calibration, in order to improve the accuracy of a certain sensor, any information about the same sensor cannot be used. In contrast, because the information about a different type of sensor is used in the monitoring apparatus of embodiment 3, the calibration method of this embodiment is suitable for automatic calibrations. A fundamental problem of whether or not the assumed positions 131 are correct (i.e., whether the monitor object 100 really exists there) can be solved by carrying out the calibration iteratedly because, from the viewpoint of characteristics of the calibration, if the acquired values are correct, they become stable and then converge to stable correct values, whereas unless the values are incorrect, the parameters become unstable while the values converge to stable correct values.

When the sensor output of either the position detection sensor using electromagnetic wave 1 or the second sensor 4 can be trusted absolutely, the calibration means can alternatively carry out the calibration by using, as the teacher signal, the output signal of either the sensor which can be trusted or the sensor used as reference. For example, when the output of the second sensor 4 is used as reference because the second sensor 4 has an adequate degree of accuracy, the calibration means 11 does not perform any calibration on the second sensor 4, but performs a calibration on the position detection sensor using electromagnetic wave 1 using the assumed positions 121 of the second sensor 4 as the teacher signal, instead of the assumed positions 131, so as to adjust the parameters of the position detection sensor using electromagnetic wave 1 so that the assumed positions 113 get closer to the assumed positions 121 as close as possible.

As previously mentioned, the monitoring apparatus according to embodiment 3 can carry out the calibration again not only at a time when the monitoring apparatus is installed but also at a time when the monitoring apparatus is operating under normal conditions, it can improve the accuracy of each of the position detection sensor using electromagnetic wave 1 and the second sensor 4 during normal operation. As a result, the accuracy can be maintained during normal operation while the calibration cost at the time when the monitoring apparatus is installed is reduced, and spending much time on the calibration can achieve a higher-accuracy calibration compared with the case where the calibration is carried out only at the time when the monitoring apparatus is installed. Generally, in many cases, the machine accuracy and installation accuracy of a sensor change and degrade with time. However, because the monitoring apparatus according to this embodiment can carry out the calibration successively, the present embodiment can also offer an advantage of reducing the change and degradation in the machine accuracy and installation accuracy of each of the sensors.

As mentioned above, the monitoring apparatus according to embodiment 3 includes the calibration means for calibrating the output of at least one of the first and second sensors on the basis of the output of the distribution computing means. Therefore, the monitoring apparatus can calibrate each of the sensors during its normal operation, and therefore can improve the detection accuracy during normal operation.

Many widely different embodiments of the present invention may be constructed without departing from the spirit and scope of the present invention. It should be understood that the present invention is not limited to the specific embodiments described in the specification, except as defined in the appended claims.

What is claimed is:

1. A monitoring apparatus for monitoring an object in an area, the monitoring apparatus comprising:

a first sensor that outputs a first distribution of possible positions of the object in a first monitor area;

a second sensor that outputs a second distribution of possible positions of the object in a second monitor area which overlaps said first monitor area;

distribution computing means for performing a weighted addition of the first and second distributions output by the first and second sensors for an area where said first monitor area and said second monitor area overlap to compute an integrated distribution of a position range of the object; and information presenting means for outputting the integrated distribution acquired by said distribution computing means for a display.

2. The monitoring apparatus according to claim 1, wherein said first and second sensors are of different types.

3. The monitoring apparatus according to claim 2, further comprising:

calibration means for calibrating an output of at least one of said first and second sensors on a basis of an output of said distribution computing means.

4. The monitoring apparatus according to claim 2, wherein the first sensor is a position detection sensor using an electromagnetic wave, and the second sensor includes an image pickup device that acquires an image of the second monitor area, and an image processing device that detects an occurrence of an event different from normal events from the image acquired by said image pickup device.

5. The monitoring apparatus according to claim 4, wherein the position detection sensor has two leakage coaxial cables to detect a position of the object, which exists between the two leakage coaxial cables.

6. The monitoring apparatus according to claim 2, wherein the first sensor is a position detection sensor using an electromagnetic wave, and the second sensor is a tag sensor that detects a position of a Radio Frequency Identification (RFID) tag.

7. The monitoring apparatus according to claim 6, wherein the position detection sensor has two leakage coaxial cables to detect a position of the object, which exists between the two leakage coaxial cables.

8. The monitoring apparatus according to claim 2, wherein the first sensor is a range sensor using a laser scanner, and the second sensor is a pressure-sensitive position detecting sensor.

9. The monitoring apparatus according to claim 1, wherein the monitoring apparatus monitors an occurrence of an intrusion of a person into the first or second monitor areas.

10. The monitoring apparatus according to claim 1, wherein the monitoring apparatus detects a position of the object, which exists in the first or second monitor areas.

11. The monitoring apparatus according to claim 1, wherein said information presenting means outputs the first distribution of the first sensor and the second distribution of the second sensor separately.

12. A method for a monitoring apparatus that monitors an object in an area, the method comprising:

outputting, with a first sensor of the monitoring apparatus, a first distribution of possible positions of the object in a first monitor area;

outputting, with a second sensor of the monitoring apparatus, a second distribution of possible positions of the object in a second monitor area which overlaps said first monitor area;

performing, with the monitoring apparatus, a weighted addition of the first and second distributions output by the first and second sensors for an area where said first monitor area and said second monitor area overlap to compute an integrated distribution of a position range of the object; and outputting, with an information presenting unit of the monitoring apparatus, the integrated distribution for a display.

* * * * *